United States Patent [19]

Brown et al.

[11] Patent Number: 4,915,809

[45] Date of Patent: Apr. 10, 1990

[54] CARBON ELECTRODES INCLUDING TRASITION METAL DISPERSED THEREIN

[75] Inventors: Oliver R. Brown, Tyne and Wear; Martyn J. Wilmott, Stockton, both of United Kingdom

[73] Assignee: British Nuclear Fuels Plc, United Kingdom

[21] Appl. No.: 267,616

[22] Filed: Nov. 2, 1988

Related U.S. Application Data

[63] Continuation of Ser. No. 66,145, Jun. 25, 1987, abandoned.

[30] Foreign Application Priority Data

Aug. 1, 1986 [GB] United Kingdom ..... 8618909

[51] Int. Cl.[4] ..... C25C 3/00

[52] U.S. Cl. ..... 204/243 R; 204/60; 204/292; 204/294

[58] Field of Search ..... 204/243 R, 292, 294, 204/60, 291

[56] References Cited

U.S. PATENT DOCUMENTS

| | | | |
|---|---|---|---|
| 2,534,638 | 12/1950 | Swinehart | 204/60 |
| 4,011,374 | 3/1977 | Kaun | 429/220 |
| 4,086,404 | 4/1978 | Vesero et al. | 429/220 |
| 4,282,074 | 8/1981 | DuBois | 204/98 |
| 4,312,718 | 1/1982 | Watanabe et al. | 204/60 |
| 4,568,442 | 2/1986 | Goldsmith | 204/284 |

FOREIGN PATENT DOCUMENTS

| | | |
|---|---|---|
| 8541627 | 4/1985 | Australia . |
| 0163597 | 12/1985 | European Pat. Off. . |
| 3538294 | 4/1987 | Fed. Rep. of Germany . |
| 957168 | 5/1964 | United Kingdom . |
| 1078936 | 8/1967 | United Kingdom . |
| 1137743 | 12/1968 | United Kingdom . |
| 1277620 | 6/1972 | United Kingdom . |
| 2054650 | 2/1981 | United Kingdom . |

OTHER PUBLICATIONS

A. T. Kuhn (Editor), *Industrial Electrochemical Processes*, Elsevier Publishing Co., 1971.

*Primary Examiner*—John F. Niebling
*Assistant Examiner*—Kathryn Gorgos
*Attorney, Agent, or Firm*—Larson and Taylor

[57] ABSTRACT

A carbon anode for a fluorine-producing cell is doped with a very fine dispersion of one or more transition metals, preferably nickel, vanadium and/or cobalt. The transition metal may be dispersed within the particles and/or the binder and is conveniently introduced in the form of an organic complex of the transition metal which decomposes during heat treatment of the consolidated mass of particles and binder.

10 Claims, No Drawings

CARBON ELECTRODES INCLUDING TRASITION METAL DISPERSED THEREIN

This application is a continuation of application Ser. No. 066,145 filed June 25, 1987, now abandoned.

This invention relates to carbon electrodes such as are used in the production of fluorine by electrolysis of a mixed molten salt electrolyte using a porous carbon anode, the electrolyte usually comprising potassium, fluoride and hydrogen fluoride.

According to one aspect of the present invention, there is provided a carbon electrode at least part of which has one or more transition metals atomically dispersed therein.

In practice, the transition metal(s) may be dispersed through the entire carbon electrode although it is within the ambit of the invention for transition metal doping to be confined to those parts of the electrode which, in use, are or will become (as a result of electrode material loss in the course of electrolysis) exposed to the electrolyte.

According to a second aspect of the invention, there is provided a carbon electrode comprising a consolidated mass of carbon particles and the residue of a carbonaceous binder, the particles and/or binder residue of at least part of the electrode having one or more transition metals substantially atomically dispersed therein.

According to a further aspect of the invention, there is provided a carbon electrode comprising a consolidated mass of carbon particles and the residue of a carbonaceous binder, the particles of at least part of the electrode having one or more transition metals dispersed therein.

The transition metal(s) may be dispersed within the particles by incorporating the transition metal within a precursor material which is subsequently carbonized and finely divided to produce the carbon particles and, in this event, it is preferred to combine the transition metal with the precursor while the latter is in a liquid phase so that atomic dispersion of the transition metal is facilitated. For example, the transition metal may be provided in the form of a thermally decomposable organic complex of the metal, eg. the transition metal combined with an organic ligand such as acetyl acetonate, and may be dissolved in a suitable liquid vehicle, such as furfuryl alcohol, for mixing with the liquid phase precursor. The precursor may then be carbonized, the organic ligand being one which will decompose at temperatures within the range normally used in the carbonization of precursor materials for carbon electrode production. After carbonization, the precursor may be pulverised to produce particles of conventional size for carbon electrode production, and the particles can then be combined with a suitable binder, such as pitch tar, consolidated and heat treated to produce a porous carbon electrode comprising the particles and the residue of the pitch tar.

The precursor may be a derivative of petroleum or coal-tar, eg. it may be a petroleum derivative from which petroleum coke is conventionally produced for use in carbon electrode manufacture.

The transition metal elements are preferably selected from nickel, vanadium and cobalt and may be used in combination, eg. both nickel and vanadium doping of the precursor and/or binder may be employed.

Although, at present, it is considered desirable to disperse the transition metal on an atomic scale, a coarser dispersion is within the scope of the invention and preferably the dispersion is such that an arbitrary slice of the electrode or electrode part having a thickness of the order of $10^{-9}$ meters is sufficiently thick to wholly encompass at least one transition metal site. In practice, it is recognized that some agglomeration of the transition metal atoms/particles may occur during preparation of the precursor for example but preferably a substantial part of the transition metal is dispersed to the extent just mentioned. Expressed in alternative terms, it is preferred that the major part of the transition metal dopant is present as centers with diameters no greater than $1\times10^{-9}$ meters.

The or each transition metal is typically present in an amount less than 1.0 atom % and preferably up to about 0.1 atom %.

Especially where the transition metal(s) is/are selected from nickel, vanadium and cobalt, the invention has particular application to carbon anodes as used in fluorine-producing electrolytic cells. It is known that operation of fluorine cells leads to the formation at the anode surface of an extremely thin film of carbon monofluoride $(CF)_x$—typically of the order of $10^{-9}$ meters thick—which significantly increases the anode operating voltage needed for efficient cell operation. The introduction of a very fine dispersion of these transition metals ensures that transition metal ion sites (resulting from oxidation of the transition metal centers present in the fluoride film) are available within the thickness of the $(CF)_x$ film thereby facilitating electron transfer between the electrolyte and the anode. In operation, the anode tends to erode and consequently the $(CF)_x$ film is continually following erosion of the anode surface and therefore encompasses fresh transition metal ion sites. The possibility of enhancement of electron transfer by the transition metal ion sites is thought to counteract the effect of the $(CF)_x$ film formation which is believed to reduce the probability of electron transfer from $HF_2-$ species. Thus the presence of the transition metal dopants, nickel, cobalt and/or vanadium, serves to reduce the anode overvoltage.

Various other aspects and features of the invention will be apparent from the appended claims.

We claim:

1. In an electrolytic cell for the production of fluorine, said cell comprising a molten fluorine-containing salt electrolyte and means, including a carbon anode, for providing electrolysis of said electrolyte to generate fluorine, the improvement wherein the carbon anode comprises a consolidated mass consisting essentially of carbon particles, and less 1.0 atoms % of a transition metal, at least a substantial part of the transition metal being dispersed within the consolidated mass as a very fine dispersion of metal sites having diameters no greater than $1\times10^{-9}$ meters, to thereby inhibit anode over-voltage during operation of the cell.

2. An electrolytic cell as claimed in claim 1, wherein the consolidated mass includes a carbonized residue of a carbonaceous binder, and the transition metal is also disposed within the residue.

3. An electrolytic cell as claimed in claim 2, wherein the transition metal is selected from the group consisting of nickel, vanadium and cobalt.

4. An electrolytic cell as claimed in claim 1, wherein a plurality of said transition metals are provided, each said transition metal being present in an amount less than 1.0 atom %, and each said transition metal having a substantial part thereof dispersed within the consolidated mass as a very fine dispersion of metal sites having diameters no greater than $1 \times 10^{-9}$ meters.

5. An electrolytic cell as claimed in claim 4, wherein the consolidated mass includes a carbonized residue of a carbonaceous binder, and the transition metals are also dispersed within the residue.

6. An electrolytic cell as claimed in claim 5, wherein the transition metals are selected from the group consisting of nickel, vanadium or cobalt.

7. An electrolytic cell as claimed in claim 4, wherein the transition metals are selected from the group consisting of nickel, vanadium or cobalt.

8. An electrolytic cell as claimed in claim 4, wherein each said transition metal is present in an amount up to 0.1 atom %.

9. An electrolytic cell as claimed in claim 1, wherein the transition metal is selected from the group consisting of nickel, vanadium and cobalt.

10. An electrolytic cell as claimed in claim 1, wherein the transition metal is present in an amount up to 0.1 atom %.

* * * * *